US011430604B2

(12) United States Patent
Idogawa

(10) Patent No.: US 11,430,604 B2
(45) Date of Patent: Aug. 30, 2022

(54) IGNITION COIL

(71) Applicant: Mitsubishi Electric Corporation, Tokyo (JP)

(72) Inventor: Takashi Idogawa, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 811 days.

(21) Appl. No.: 16/338,768

(22) PCT Filed: Oct. 11, 2016

(86) PCT No.: PCT/JP2016/080116
§ 371 (c)(1),
(2) Date: Apr. 2, 2019

(87) PCT Pub. No.: WO2018/069962
PCT Pub. Date: Apr. 19, 2018

(65) Prior Publication Data

US 2021/0287850 A1 Sep. 16, 2021

(51) Int. Cl.
*H01F 38/12* (2006.01)
*H01F 27/02* (2006.01)

(52) U.S. Cl.
CPC ..... *H01F 38/12* (2013.01); *H01F 27/022* (2013.01); *H01F 2038/127* (2013.01)

(58) Field of Classification Search
CPC ... H01F 38/12; H01F 2038/127; H01F 27/022
USPC ..... 336/90, 92, 94, 96; 123/634, 635
See application file for complete search history.

(56) References Cited

U.S. PATENT DOCUMENTS

2005/0134416 A1* 6/2005 Maekawa ..... H01F 27/324 336/92
2006/0226945 A1* 10/2006 Maekawa ..... H01F 38/12 336/90
2008/0266040 A1* 10/2008 Matsubayashi ..... H01F 27/022 336/96
2018/0025835 A1* 1/2018 Idogawa ..... H01F 38/12 336/110
2018/0240589 A1* 8/2018 Idogawa ..... H01F 3/14
(Continued)

FOREIGN PATENT DOCUMENTS

JP 7-263256 A 10/1995
JP 2015-201555 A 11/2015

*Primary Examiner* — Phutthiwat Wongwian
*Assistant Examiner* — Arnold Castro
(74) *Attorney, Agent, or Firm* — Sughrue Mion, PLLC; Richard C. Turner

(57) ABSTRACT

An ignition coil includes: a center core; a primary coil wound around the center core; a secondary coil wound around the primary coil; a plurality of side cores, which are arranged around the secondary coil, and are coupled to the center core to form a closed magnetic path; a magnet inserted between the plurality of side cores; an igniter configured to control supply and interruption of a current to the primary coil; a case configured to accommodate the center core, the primary coil, the secondary coil, the plurality of side cores, the magnet, and the igniter; and insulating resin filled in the case. The side cores include a wide portion and a narrow portion. The magnet is inserted into the wide portion. The igniter is arranged between the narrow portion and the case.

20 Claims, 6 Drawing Sheets

(56) References Cited

U.S. PATENT DOCUMENTS

2019/0214177 A1* 7/2019 Idogawa ..... H01F 27/022
2021/0265107 A1* 8/2021 Suzuki ..... H01F 38/12

* cited by examiner

IGNITION COIL

CROSS REFERENCE TO RELATED APPLICATIONS

This application is a National Stage of International Application No. PCT/JP2016/080116, filed on Oct. 11, 2016.

TECHNICAL FIELD

The present invention relates to an ignition coil, which is mounted on, for example, an internal combustion engine, and is configured to supply a high voltage to an ignition plug so as to generate spark discharge.

BACKGROUND ART

In recent years, in order to improve fuel efficiency, there has been developed a vehicle having mounted thereon an internal combustion engine, which is increased in compression ratio. In order to increase the compression ratio, it is required to increase an output voltage of an ignition coil. However, there is a limit to a mounting space for the ignition coil, and hence dimensions of the ignition coil cannot be increased. In view of this, there has been proposed a technology for increasing a cumulative amount of magnetic energy without increasing the dimensions of the ignition coil through insertion of a magnet, which is magnetized in a direction opposite to a direction of excitation through energization of a primary coil, in a closed magnetic path of a core (see, for example, Patent Literature 1).

CITATION LIST

Patent Literature

[PTL 1] JP 07-263256 A

SUMMARY OF INVENTION

Technical Problem

However, in the configuration of Patent Literature 1, for example, the magnet cannot be increased in size in a thickness direction of the core, and hence there is a limit to increase in size of the magnet.

The present invention has been made to solve the problem as described above, and has an object to obtain an ignition coil, which is increased in output voltage without increasing dimensions.

SOLUTION TO PROBLEM

According to one embodiment of the present invention, there is provided an ignition coil, including: a center core; a primary coil wound around the center core; a secondary coil wound around the primary coil; side cores, which are arranged around the secondary coil, and are coupled to the center core to form a closed magnetic path; a magnet inserted between the plurality of side cores; an igniter configured to control supply and interruption of a current to the primary coil; a case configured to accommodate the center core, the primary coil, the secondary coil, the side cores, the magnet, and the igniter; and insulating resin filled in the case, wherein the side cores include a wide portion having a larger width in a direction from the center core to the side cores, and a narrow portion having a smaller width than the width of the wide portion, wherein the magnet is inserted into the wide portion, and wherein the igniter is arranged between the narrow portion and the case.

Advantageous Effects of Invention

The wide portion and the narrow portion are formed on the side cores, the magnet is arranged on the wide portion, and the igniter is arranged between the narrow portion and the case. With this, an output voltage can be increased without increasing the dimensions of the outer shape of the ignition coil.

DESCRIPTION OF EMBODIMENTS

Now, an ignition coil according to first to fourth embodiments of the present invention is described with reference to the drawings.

First Embodiment

Figure 1:
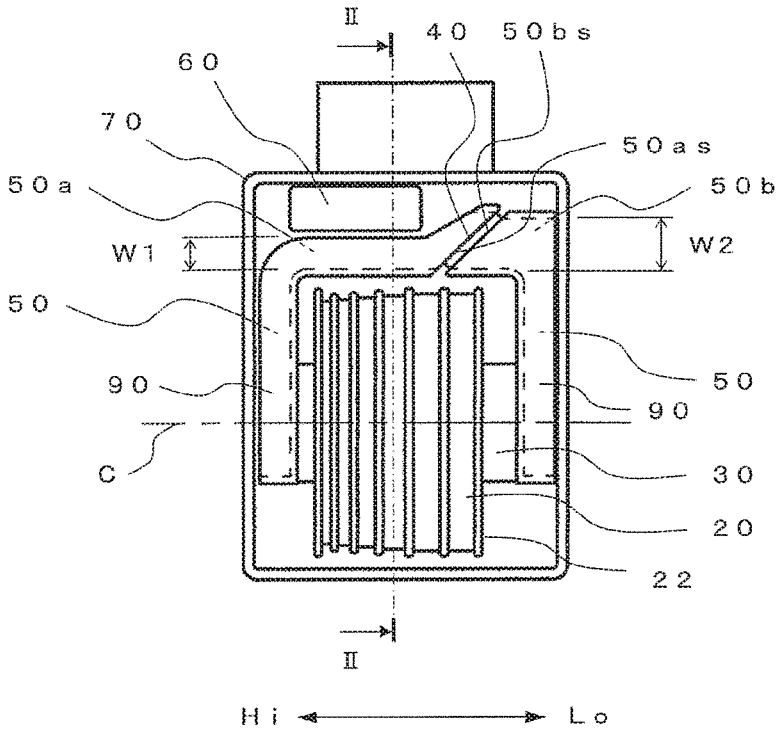
FIG. 1 is a view for illustrating an ignition coil according to a first embodiment of the present invention.

FIG. 1 is a configuration view for illustrating an ignition coil according to a first embodiment of the present invention. Further, FIG. 2 is a sectional view taken along the line II-II in FIG. 1.

Figure 2:
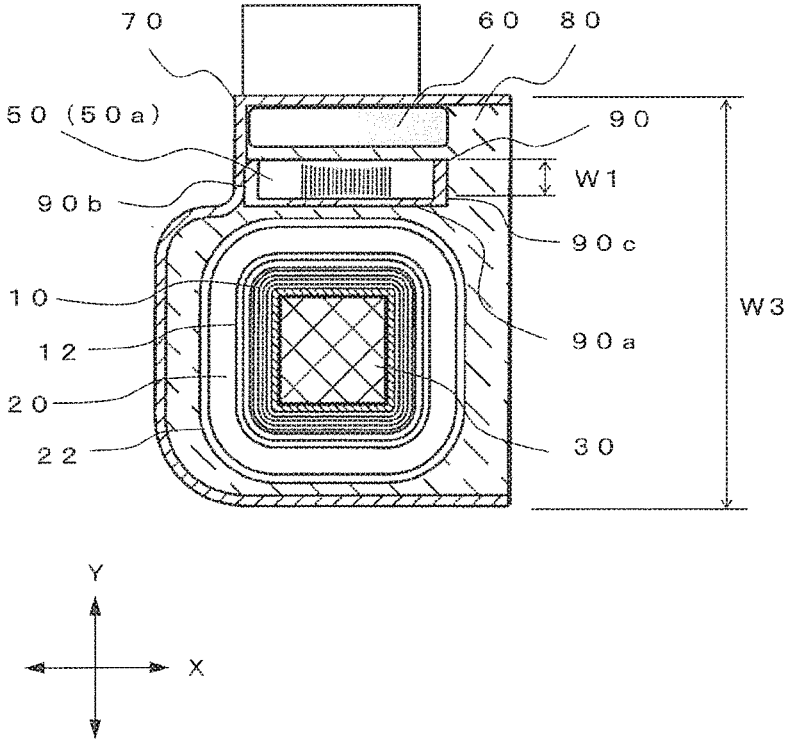
FIG. 2 is a sectional view for illustrating the ignition coil taken along the line II-II in FIG. 1.

As illustrated in FIG. 1 and FIG. 2, the ignition coil according to the first embodiment includes a center core 30 and a C-type side core 50. The C-type side core 50 having a C shape surrounds a primary coil 10 and a secondary coil 20. The center core 30 and the side core 50 form a closed magnetic path. Further, an igniter 60 is arranged between the side core 50 and a case 70. The igniter 60 is configured to control supply and interruption of a primary current f lowing through the primary coil 10. The letters "Hi" and "Lo" represented with the arrows in FIG. 1 respectively indicate a high-voltage side and a low-voltage side of the ignition coil.

As illustrated in FIG. 2, the ignition coil according to the first embodiment includes, in the case 70, the primary coil 10 wound around a bobbin 12 for a primary coil. A bobbin 22 for a secondary coil is provided on an outer side of the primary coil 10, and the secondary coil 20 is wound around the bobbin 22 for a secondary coil with turns, for example, hundred times as many as turns of the primary coil 10. The I-type center core 30 having an I shape, which is magnetically coupled to the primary coil 10 and the secondary coil 20, passes through the cylindrical bobbin 12 for a primary coil.

As illustrated in FIG. 2, further, insulating resin 80 being thermosetting epoxy resin is filled in the case 70 to be cured. In FIG. 1, for easy understanding of a configuration of each of the components arranged inside the case 70, illustration of the insulating resin 80 filled in the case 70 is omitted.

In the ignition coil having the configuration as described above, the igniter 60 having received a drive signal input from an electronic control unit (not shown) interrupts the primary current flowing through the primary coil 10 at a predetermined ignition timing of an internal combustion engine so that a back electromotive force is generated in the primary coil 10 and a high voltage is generated in the secondary coil 20. Then, the high voltage thus generated is applied to an ignition plug (not shown) of the internal combustion engine, which is arranged on the high-voltage side in FIG. 1.

In the ignition coil according to the first embodiment, the side core 50 is formed of a plurality of magnetic steel sheets laminated in an X direction indicated in FIG. 2. Further, as illustrated in FIG. 1, the side core 50 is divided into two parts in a portion parallel to a center axis C of the center core 30 on the low-voltage side. The side core 50 on the high-voltage side among the divided side cores 50 includes a narrow portion 50*a* formed so as to have a width W1 in a Y direction orthogonal to the laminating direction X. Further, the side core 50 on the low-voltage side among the divided side cores 50 includes a wide portion 50*b* formed so as to have a width W2 larger than the width W1 of the narrow portion 50*a*. Further, a magnet 40 is inserted between the two divided side cores 50, and the two divided side cores 50 are coupled to each other through intermediation of the magnet 40.

Further, an end portion of the narrow portion 50*a* on a side coupled to the magnet 40 is formed so that the width is gradually increased from "W1" to "W2" toward the low-voltage side, and an end surface 50*as* of the narrow portion 50*a* is inclined so as to approach the case 70 from the secondary coil 20 toward the low-voltage side. Further, an end surface 50*bs* of the wide portion 50*b* on the high-voltage side is inclined so as to extend along the end surface 50*as* of the narrow portion 50*a*.

The magnet 40 has a flat-plate shape, and a front surface and a back surface of the magnet 40 are respectively arranged on the end surface 50*as* of the narrow portion 50*a* and the end surface 50*bs* of the wide portion 50*b* of the divided side cores 50.

As illustrated in FIG. 2, a surface 90*a* of the side core 50, which is opposed to the secondary coil 20, and both side surfaces 90*b* and 90*c* of the side core 50 in the X direction being the laminating direction are coated with an elastomer member 90. Further, the igniter 60 is arranged between a surface of the side core 50 on a side opposite to the surface 90*a* and the case 70, and the insulating resin 80 is filled between the side core 50 and the igniter 60 so that insulation is secured. When a sectional area of the narrow portion 50*a* of the side core 50 along an XII plane in FIG. 2 is set to be 80% or more of a sectional area of the center core 30 in the same direction, degradation in efficiency can be prevented.

As described above, in the ignition coil according to the first embodiment, the narrow portion 50*a* is formed on the high-voltage side of the side core 50, and the igniter 60 is arranged between the narrow portion 50*a* and the case 70 through the insulating resin 80, thereby being capable of reducing a size of an outer shape of the ignition coil. Further, the side core 50 is divided so as to be obliquely cut, and the magnet 40 having a flat-plate shape is inserted between the divided side cores 50 so as to couple the side cores 50 to each other. Thus, the large-sized magnet 40 can be inserted between the side cores 50 without increasing the size of the outer shape of the ignition coil, thereby being capable of increasing output of the ignition coil.

Second Embodiment

Figure 3:
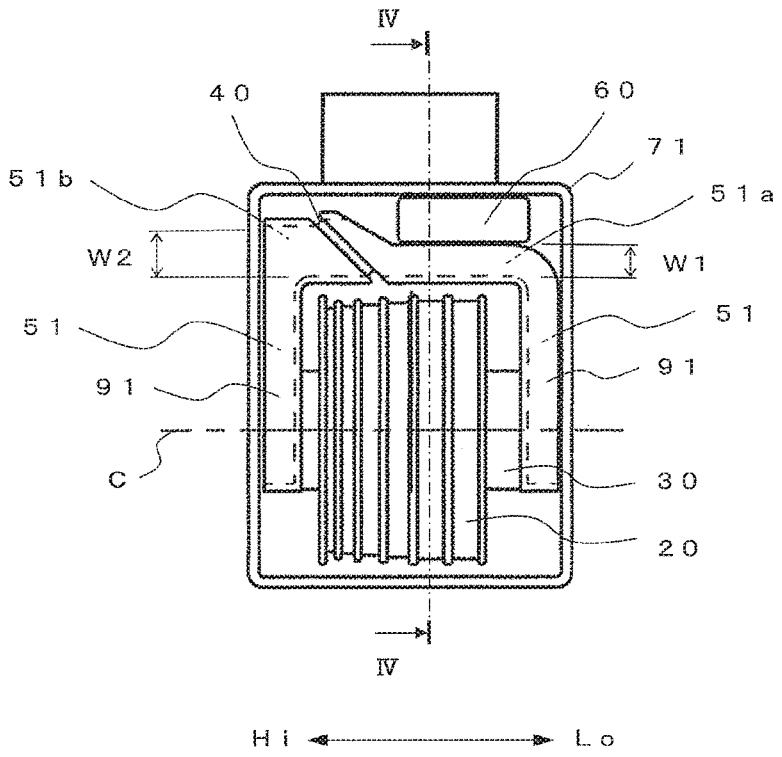
FIG. 3 is a view for illustrating an ignition coil according to a second embodiment of the present invention.
Figure 4:
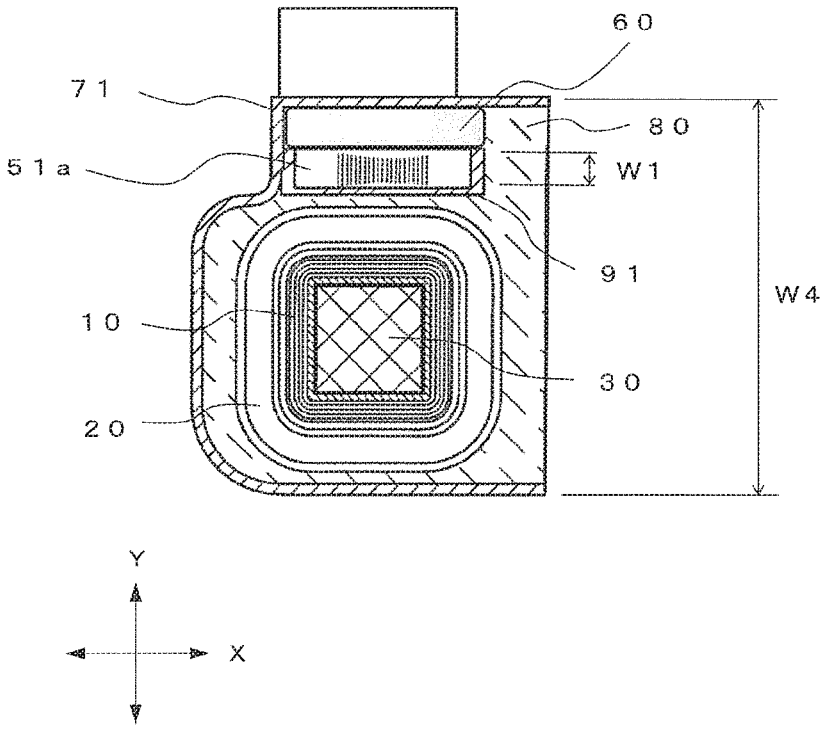
FIG. 4 is a sectional view for illustrating the ignition coil taken along the line IV-IV in FIG. 3.

FIG. 3 is a configuration view for illustrating an ignition coil according to a second embodiment of the present invention. Further, FIG. 4 is a sectional view of the ignition coil taken along the line V-IV in FIG. 3. As illustrated in FIG. 3 and FIG. 4, the ignition coil according to the second embodiment has a configuration similar to that of the first embodiment except that a shape of a side core 51, a shape of an elastomer member 91, dimensions of an outer shape of a case 71, and an arrangement position of the igniter 60 are different. Similarly to FIG. 1, in FIG. 3, illustration of the insulating resin 80 filled in the case 71 is omitted for easy understanding of a configuration of each of the components arranged inside the case 71.

As illustrated in FIG. 3, in the ignition coil according to the second embodiment, a narrow portion 51*a* of the side core 51 is formed on the low-voltage side, and a wide portion 51*b* of the side core 51 is formed on the high-voltage side. Further, as illustrated in FIG. 4, similarly to the first embodiment, the igniter 60 is arranged between the narrow port ion 51*a* and the case 71. However, the narrow portion 51*a* is formed on the low-voltage side. Thus, even when a high voltage is induced to the side core 51, there is no fear in that electricity is discharged from the narrow portion 51*a* to the outside.

As described above, in the ignition coil according to the second embodiment, the igniter 60 is arranged on the narrow portion 51*a* formed on the low-voltage side of the side core 51. Thus, unlike the first embodiment, it is not required to fill the insulating resin 80 between the narrow portion 51*a* and the igniter 60. With this, in the ignition coil according to the second embodiment, the side core 51 and the igniter 60 can be arranged close to each other so that a dimension W4 of the case 71 can be smaller than a dimension W3 of the case 70 in the first embodiment.

Third Embodiment

Figure 5:
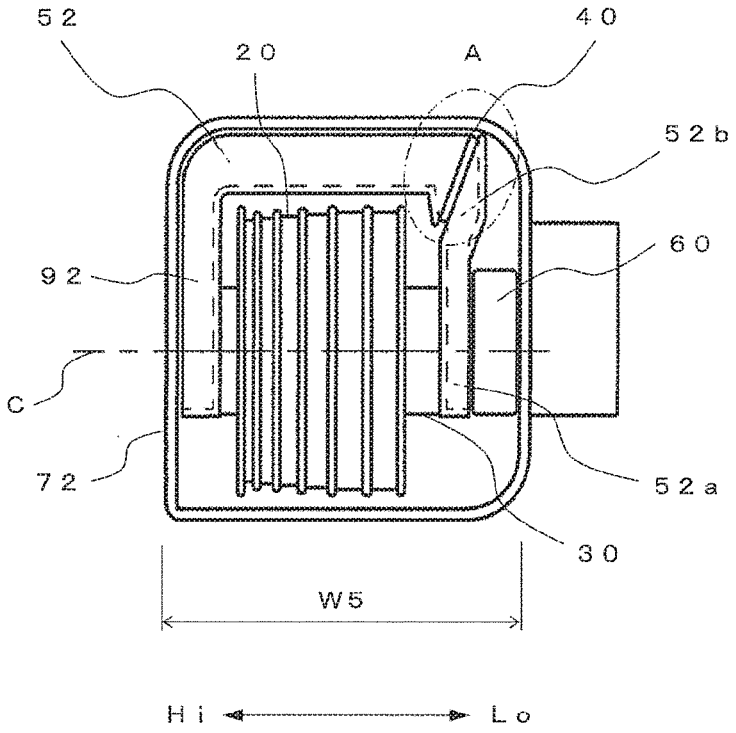
FIG. 5 is a view for illustrating an ignition coil according to a third embodiment of the present invention.
Figure 6:
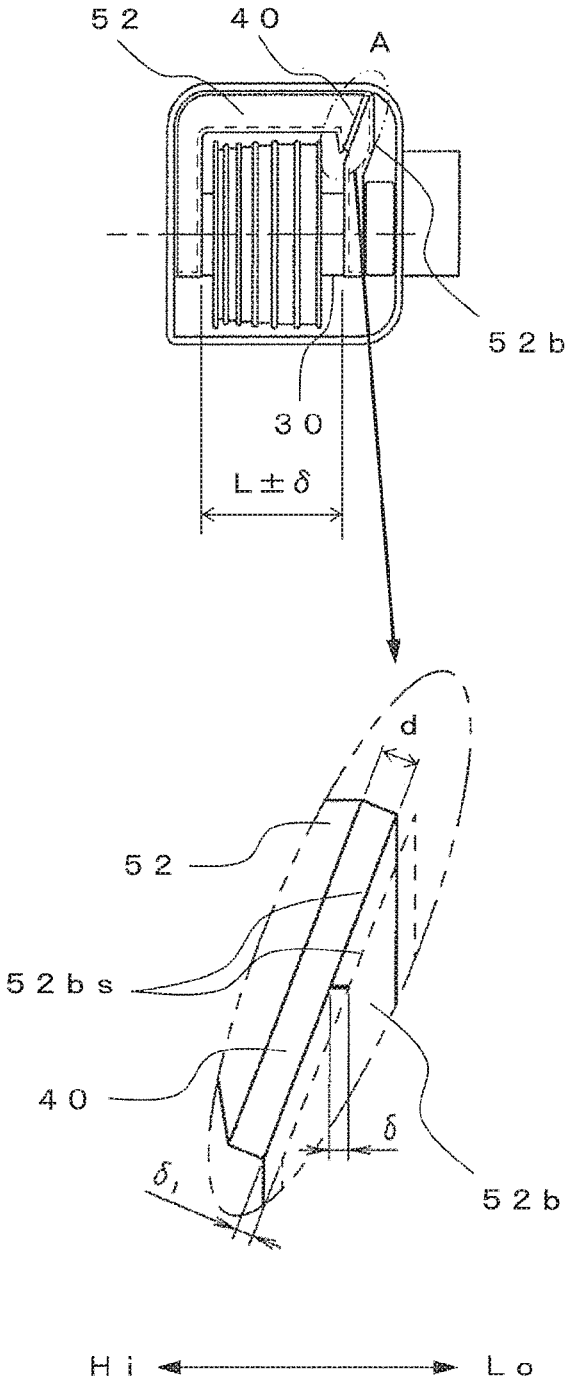
FIG. 6 is a view for illustrating a magnet insertion portion of the ignition coil according to the third embodiment of the present invention.

FIG. 5 is a configuration view for illustrating an ignition coil according to a third embodiment of the present invention. Further, FIG. 6 is an enlarged view of the ignition coil according to the third embodiment and an insertion portion for the magnet 40. As illustrated in FIC. 5, in the ignition coil according to the third embodiment, a C-type side core 52 is divided at a bent portion A on the low-voltage side, and the magnet 40 having a flat-plate shape is inserted into the bent portion A.

A narrow portion 52*a* and a wide portion 52*b* are formed on the side core 52 on the low-voltage side among the divided side cores 52, and the igniter 60 is arranged between the narrow portion 52*a* and a case 72. Further, the magnet 40 is inserted between the wide portion 52*b* of the side core 52 on the low-voltage side and the side core 52 on the high-voltage side. The side core 52 on the low-voltage side and the side core 52 on the high-voltage side, which are divided from each other, are coupled to each other through intermediation of the magnet 40. Other configurations are the same as those of the first embodiment.

As illustrated in FIG. 5, in the ignition coil according to the third embodiment, the magnet 40 is inserted into the bent portion A of the side core 52. Further, an end portion of the magnet 40 is arranged so as to extend to the center axis C side of the center core 30 with respect to an outer diameter of the secondary coil 20. With this, the magnet 40 having a larger size can be inserted between the side cores 52 without increasing a dimension W5 of an outer shape of the ignition coil.

Next, description is made with reference to FIG. 6. In this case, it is assumed that the center core 30 has a manufacture variation +5 in a dimension L in a direction of the center axis C. The solid line in the enlarged view of FIG. 5 indicates a state of the bent portion A of the side core 52 when the dimension of the center core 30 is L, and the broken line indicates a position of the wide portion 52*b* of the side core 52 when the dimension of the center core 30 is L+δ.

When the dimension of the center core 30 is changed from L to L+5, a position of a joining surface 52*bs* of the wide portion 52*b*, which is joined to the magnet 40, is moved to the low-voltage side of the ignition coil by δ. Meanwhile, an interval d of the insertion portion for the magnet 40 in the bent portion A is increased by δ1 when the dimension of the center core 30 is changed from L to L+δ. As illustrated in FIG. 6, in the ignition coil according to the third embodiment, the change amount 51 of the interval d of the insertion portion for the magnet 40 is substantially equal to the change amount δ of the dimension of the center core 30.

Fourth Embodiment

Figure 7:
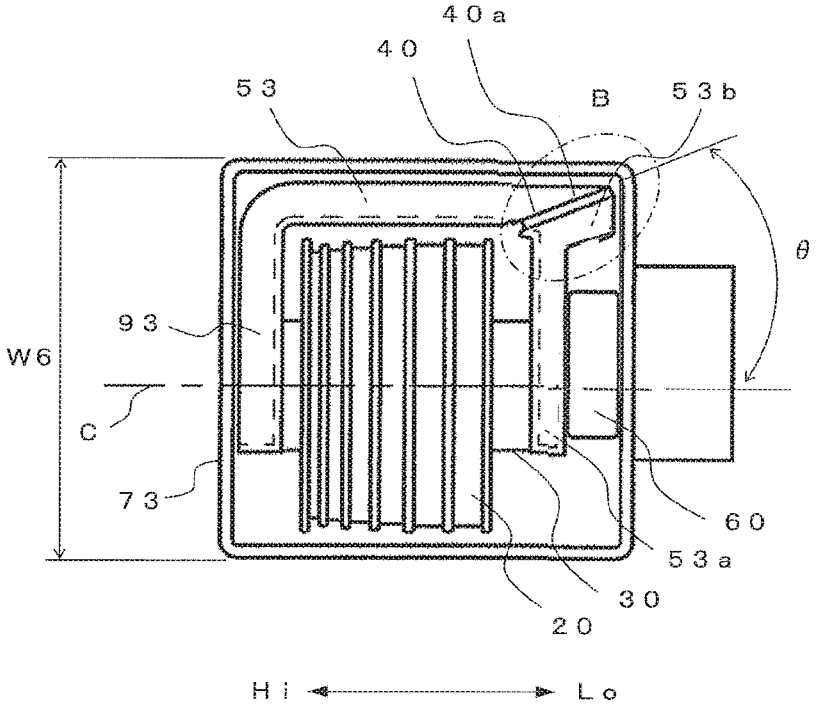
FIG. 7 is a view for illustrating an ignition coil according to a fourth embodiment of the present invention.
Figure 8:
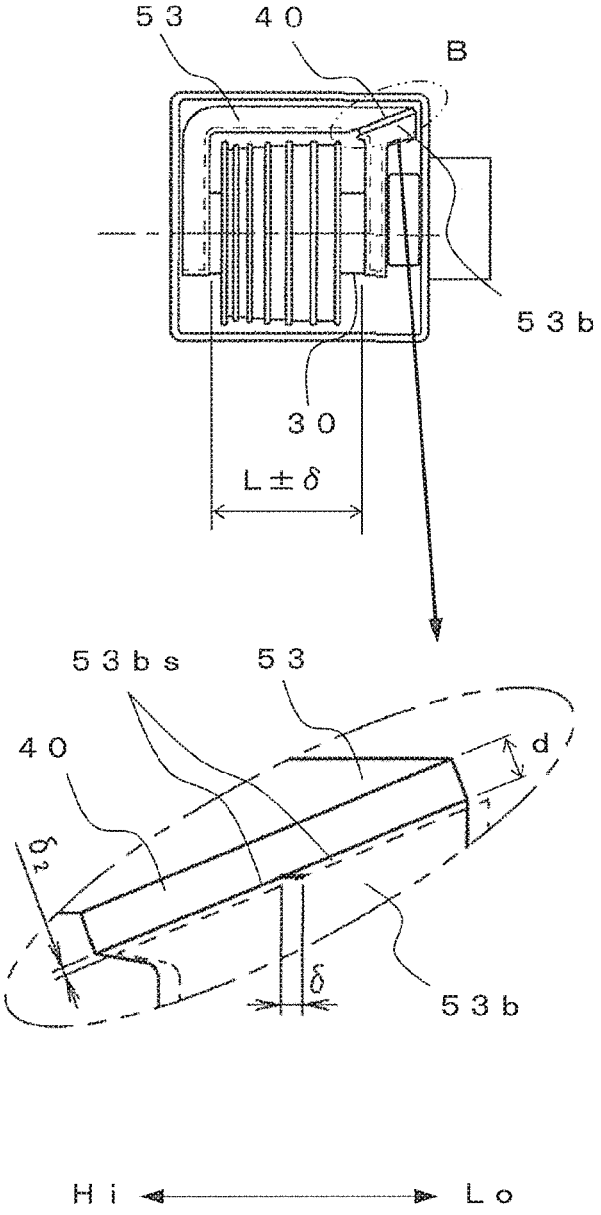
FIG. 8 is a view for illustrating a magnet insertion portion of the ignition coil according to the fourth embodiment of the present invention.

FIG. 7 is a configuration view for illustrating an ignition coil according to a fourth embodiment of the present invention Further, FIG. 8 is an enlarged view of the ignition coil according to the fourth embodiment and an insertion portion for the magnet 40. As illustrated in FIG. 7, in the ignition coil according to the fourth embodiment, similarly to the third embodiment, a C-type side core 53 is divided at a bent portion B on the low-voltage side, and the magnet 40 having a flat-plate shape is inserted into the bent portion B.

Similarly to the ignition coil according to the third embodiment, a narrow portion 53*a* and a wide portion 53*b* are formed on the side core 53 on the low-voltage side among the divided side cores 53, and the igniter 60 is arranged between the narrow portion 53*a* and a case 73. Further, the magnet 40 is inserted between the wide portion 53*b* of the side core 53 on the low-voltage side and the side core 53 on the high-voltage side. The side core 53 on the low-voltage side and the side core 53 on the high-voltage side, which are divided from each other, are coupled to each other through intermediation of the magnet 40. Other configurations are the same as those of the first embodiment.

As illustrated in FIG. 7, in the ignition coil according to the fourth embodiment, the magnet 40 is inserted into the bent portion B of the side core 53. Further, the magnet 40 is inserted into the side core 53 so that an angle θ between a joining surface 40*a* of the magnet 40, which is joined to the side core 53, and the center axis C of the center core 30 is 45° or less. With this, a width of the side core 53 in a portion parallel to the center axis C of the center core 30 in a direction from the center axis C to the case 73 can be reduced. Therefore, the magnet 40 having a larger size can be inserted into the side core 53 without increasing a dimension W6 of the ignition coil in a direction perpendicular to the center axis of the center core 30.

Next, description is made with reference to FIG. 8. In this case, as described with reference to FIG. 6, it is assumed that the center core 30 has a manufacture variation ±δ in a dimension L in the direction of the center axis C The solid line in the enlarged view of FIG. 8 indicates a state of the bent portion B of the side core 53 when the dimension of the center core 30 is L, and the broken line indicates a position of the wide portion 53*b* of the side core 53 when the dimension of the center core 30 is L+δ.

When the dimension of the center core 30 is changed from L to L+δ, similarly to the third embodiment, a position of a joining surface 53*bs* of the wide portion 53*b*, which is joined to the magnet 40, is moved to the low-voltage side of the ignition coil by δ. Meanwhile, a change amount of the interval d of the insertion portion for the magnet 40 in the bent portion B is δ2 illustrated in FIG. 8.

When the length of δ1 in relation to 5 in FIG. 6 and the length of δ2 in relation to δ in FIG. 8 are compared with each other, it is found that δ2 is smaller in relation to δ. As described above, in the ignition coil according to the fourth embodiment, the change amount δ2 of the interval d of the insertion portion for the magnet 40 in relation to the change amount δ of the dimension of the center core 30 can be smaller than the change amount δ1 in the case of the ignition coil according to the third embodiment. Therefore, in the ignition coil according to the fourth embodiment, the change amount of the dimension L of the center core 30 is absorbed by the insertion portion for the magnet 40 so that change in gap of the magnetic narrow path is suppressed to be small, thereby being capable of stabilizing the performance as the ignition coil.

In the first embodiment to the fourth embodiment, the side cores 50 to 53 are each a C-type having a C shape. However, the present invention is not limited thereto. For example, the side cores 50 to 53 may each have an O shape. Further, in the first embodiment to the fourth embodiment, the coating of the elastomer member 90 is not provided on the surface of each of the side cores 50 to 53, on which the igniter 60 is arranged. However, the present invention is not limited thereto. For example, coatings of elastomer members 90 to 93 may be respectively provided on the surfaces of the side cores 50 to 53 on the side on which the igniter 60 is arranged, which are illustrated in FIG. 1 to FIG. 6. Further, in the third embodiment and the fourth embodiment, the shape of the magnet 40 is a flat-plate shape. However, the present invention is not limited thereto. For example, the magnet 40 may have a block shape as long as the magnet 40 has surfaces, which are joinable to the side core, on front and back sides. Further, the joining surface of the magnet 40, which is joined to the side core, is not limited to the flat surface, and, for example, may have concavity and convexity.

REFERENCE SIGNS LIST

10 primary coil, 20 secondary coil, 30 center core, magnet, 50 to 53 side core, 50*a* to 53*a* narrow portion, 50*b* to 53*b* wide portion, 60 igniter, 70 to 73 case, 80 insulating resin, 90 to 93 elastomer member, A bent portion, B bent portion

The invention claimed is:

1. An ignition coil, comprising:

a center core;

a primary coil wound around the center core;

a secondary coil wound around the primary coil;

a plurality of side cores, which are arranged around the secondary coil, and are coupled to the center core to form a closed magnetic path;

a magnet inserted between the plurality of side cores;

an igniter configured to control supply and interruption of a current to the primary coil;

a case configured to accommodate the center core, the primary coil, the secondary coil, the plurality of side cores, the magnet, and the igniter; and insulating resin filled in the case, wherein the side cores include a wide portion having a larger width in a direction from the center core to the side cores, and a narrow portion having a smaller width than the width of the wide portion, wherein the magnet is inserted into the wide portion, and wherein the igniter is arranged between the narrow portion and the case.

2. An ignition coil according to claim 1, wherein the narrow portion is formed on a low-voltage side of the secondary coil.

3. An ignition coil according to claim 2, wherein the magnet has flat surfaces on front and back sides, and wherein the magnet is arranged between the side cores under a state in which the flat surfaces are inclined with respect to the side cores.

4. An ignition coil according to claim 2, wherein the magnet is arranged at a bent portion of the side cores.

5. An ignition coil according to claim 2, wherein a position in the side cores at which the magnet is inserted and a position in the side cores at which the igniter is arranged are set to a portion at which the side cores are extended in a direction perpendicular to the center axis of the center core.

6. An ignition coil according to claim 2, wherein a sectional area of the side cores at the narrow portion on which the igniter is arranged in the direction perpendicular to the center axis of the center core is 80% or more of a sectional area of the center core in the direction perpendicular to the center axis of the center core.

7. An ignition coil according to claim 2, wherein at least a portion of the side cores on which the igniter is arranged is coated with an elastomer member.

8. An ignition coil according to claim 1, wherein the magnet has flat surfaces on front and back sides, and wherein the magnet is arranged between the side cores under a state in which the flat surfaces are inclined with respect to the side cores.

9. An ignition coil according to claim 8, wherein the magnet is arranged between the side cores so that the flat surfaces are inclined at an angle of 45° or less with respect to a center axis of the center core.

10. An ignition coil according to claim 9, wherein the magnet is arranged at a bent portion of the side cores.

11. An ignition coil according to claim 9, wherein a position in the side cores at which the magnet is inserted and a position in the side cores at which the igniter is arranged are set to a portion at which the side cores are extended in a direction perpendicular to the center axis of the center core.

12. An ignition coil according to claim 9, wherein a sectional area of the side cores at the narrow portion on which the igniter is arranged in the direction perpendicular to the center axis of the center core is 80% or more of a sectional area of the center core in the direction perpendicular to the center axis of the center core.

13. An ignition coil according to claim 8, wherein the magnet is arranged at a bent portion of the side cores.

14. An ignition coil according to claim 8, wherein a position in the side cores at which the magnet is inserted and a position in the side cores at which the igniter is arranged are set to a portion at which the side cores are extended in a direction perpendicular to the center axis of the center core.

15. An ignition coil according to claim 8, wherein a sectional area of the side cores at the narrow portion on which the igniter is arranged in the direction perpendicular to the center axis of the center core is 80% or more of a sectional area of the center core in the direction perpendicular to the center axis of the center core.

16. An ignition coil according to claim 8, wherein at least a portion of the side cores on which the igniter is arranged is coated with an elastomer member.

17. An ignition coil according to claim 1, wherein the magnet is arranged at a bent portion of the side cores.

18. An ignition coil according to claim 1, wherein a position in the side cores at which the magnet is inserted and a position in the side cores at which the igniter is arranged are set to a portion at which the side cores are extended in a direction perpendicular to the center axis of the center core.

19. An ignition coil according to claim 1, wherein a sectional area of the side cores at the narrow portion on which the igniter is arranged in the direction perpendicular to the center axis of the center core is 80% or more of a sectional area of the center core in the direction perpendicular to the center axis of the center core.

20. An ignition coil according to claim 1, wherein at least a portion of the side cores on which the igniter is arranged is coated with an elastomer member.

* * * * *